US006302655B1

(12) United States Patent
Popov

(10) Patent No.: US 6,302,655 B1
(45) Date of Patent: Oct. 16, 2001

(54) JET PUMP AND PORTING FOR A PUMPING-EJECTION UNIT

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/446,235

(22) PCT Filed: Apr. 16, 1999

(86) PCT No.: PCT/IB99/00686

§ 371 Date: Dec. 17, 1999

§ 102(e) Date: Dec. 17, 1999

(87) PCT Pub. No.: WO99/54631

PCT Pub. Date: Oct. 28, 1999

(30) Foreign Application Priority Data

Apr. 20, 1998 (RU) ..... 98107353

(51) Int. Cl.[7] ..... F04B 23/04

(52) U.S. Cl. ..... 417/77; 417/87; 62/116; 62/500

(58) Field of Search ..... 417/77, 87, 151; 62/116, 500, 191

(56) References Cited

U.S. PATENT DOCUMENTS 1,810,873 * 6/1931 Sim ..... 62/116
2,088,609 * 8/1937 Randel ..... 62/500
3,796,640 * 3/1974 Boomer ..... 451/450
4,015,369 * 4/1977 Dietrick ..... 51/2

FOREIGN PATENT DOCUMENTS 1092044 11/1960 (DE) .
2016268 7/1994 (RU) .
1955 11/1926 (SU) .
559098 7/1977 (SU) .
866298 9/1981 (SU) .
1733714 5/1992 (SU) .

OTHER PUBLICATIONS

Lyamaev B.F., "Hydrojet pumps and units" book, 1988, USSR, Leningrad, "Mashinostroenie" Publishing house, pp. 139–141.

* cited by examiner

*Primary Examiner*—Cheryl J. Tyler
(74) *Attorney, Agent, or Firm*—Mark A. Oathout

(57) ABSTRACT

The invention relates to the field of jet technology.

Essentially a pumping-ejector unit comprises a separator and a liquid-gas ejector. Gas inlet of the ejector is connected to a source of evacuated medium, outlet of the ejector is connected to the separator and nozzle's inlet of the ejector is connected to the discharge side of a pump. The pumping-ejector unit is furnished with a jet pump. Outlet of the jet pump is connected to the suction side of the pump, nozzle's inlet of the jet pump is connected to the discharge side of the pump, evacuated medium inlet of the jet pump is connected to the separator. There is another variant of embodiment of the unit, wherein the nozzle's inlet of the jet pump is connected to a source of ejecting medium.

The described pumping-ejector unit exhibits an increased reliability and effectiveness and it has a wider control range of operation modes.

4 Claims, 1 Drawing Sheet

JET PUMP AND PORTING FOR A PUMPING-EJECTION UNIT

TECHNICAL FIELD

The invention pertains to the field of jet technology, primarily to units for producing vacuum and gas compression.

BACKGROUND ART

There is a pumping-ejector unit, comprising a pump, a separator and a jet apparatus, wherein the water, fed into the jet apparatus by the pump, falls down by gravity and thus entrains into the apparatus the air being compressed. Then the air is separated from the water in the separator. The compressed air from the separator is delivered to consumers and the water is fed back into the jet apparatus by the pump (see SU patent, 1955, MPK 6 F04 F 5/12, Nov. 30, 1926).

Significant imperfection of this compression unit is dependence of the unit's effectiveness on the jet apparatus' height, that results in significant increase of unit's dimensions and in high specific material consumption during its manufacture.

The closest analogue of the unit, described in the invention, in its technical essence and in the achieved result is a pumping-ejector unit, comprising a pump, a separator and a liquid-gas ejector, wherein the liquid-gas ejector is connected through its gas inlet to a source of evacuated medium, through its outlet—to the separator, discharge side of the pump is connected to the ejector's nozzle (see, Lyamaev B. F., "Hydro-jet pumps and units" book, Leningrad, "Mashinostroenie", 1988, pages 139–141).

This compression unit can be used for evacuation and compression of various gaseous mediums. However, efficiency factor of such units is relatively low due to high required power input.

DISCLOSURE OF INVENTION

The problems to be solved in this invention are increase of reliability and effectiveness of the unit and extension of the control range of its operating modes.

These problems are solved by the following: pumping-ejector unit, comprising a pump, a separator and a liquid-gas ejector, whose gas inlet is connected to a source of evacuated medium, nozzle is connected to the discharge side of the pump and outlet is connected to the separator, is furnished with a jet pump. Outlet of this jet pump is connected to the suction side of the pump, inlet of the jet pump's nozzle is connected to the discharge side of the pump and evacuated medium inlet of the jet pump is connected to the separator.

There is another variant of embodiment of the pumping-ejector unit, which comprises a pump, a separator and a liquid-gas ejector, whose gas inlet is connected to a source of evacuated medium, nozzle is connected to the discharge side of the pump and outlet is connected to the separator, where the unit is furnished with a jet pump, outlet of the jet pump is connected to the suction side of the pump, nozzle's inlet of the jet pump is connected to a source of ejecting medium, evacuated medium inlet of the jet pump is connected to the separator.

Besides the unit can be equipped with an additional pump with its suction side being connected to the separator and discharge side being connected to the nozzle's inlet of the jet pump.

The conducted research works have shown that the jet pump installed before the suction duct of the pump allows to increase pressure at the pump's suction side and consequently to increase pump's discharge pressure without modification of characteristics of the pump itself. As a result pressure of a motive liquid in the nozzle of the liquid-gas ejector is increased, that allows to reach deeper vacuum and to increase capacity of the ejector. At the same time anti-cavitation reserve of the pump rises. That is achieved by some means. One of the variants of realization of these objectives is cross-over of a part of the motive liquid from the discharge side of the pump into the nozzle of the jet pump, whereas outlet of the jet pump is connected to the suction side of the pump and evacuated medium inlet of the jet pump is connected to the separator. In contrast to ordinary bypassing of a part of the motive liquid from the pump's discharge side to the pump's suction side, availability of the jet pump before the main pump ensures bypassing of the motive liquid without reduction of flow rate of the motive liquid being fed into the nozzle of the liquid-gas ejector, because the jet pump provides not only increase of pressure at the pump's suction side but also increase of motive liquid volume being delivered to the pump inlet. As a result, along with the rise of the pump discharge pressure, capacity of the pump also increases. Just a part of this "surplus" flow is fed into the nozzle of the jet pump. Unlike the above described unit's design, another variant of embodiment of the unit provides for delivery of a motive liquid medium (ejecting medium) into the nozzle of the jet pump from an external source. This variant is preferred when the unit is intended not only for evacuation and compression of a gaseous medium, but also for delivery (pumping) of the motive liquid medium. Besides, the latter variant of the unit allows for permanent make-up of the circulating motive liquid. That can be applied when the motive liquid can react with the evacuated gas. Therefore such units can be used at the same time as chemical reactors, for example for hydrochloric acid production.

There is also the unit's variant providing for the use of an additional pump for feed of the motive liquid from the separator into the nozzle of the jet pump. This variant gives an opportunity to increase capacity of the unit or to equip the unit with pumps of lower capacity in view of unchanged unit's capacity. In a number of cases it allows to make the unit more compact.

One more problem, which can be solved with the described unit, is the securing of reliable operation of the unit when pressure in the separator is below the atmospheric one. This problem arises when the pumping-ejector unit is used as the first stage of a multi-stage vacuum system. In the case in question the jet pump allows to boost pressure of the motive liquid up to the pressure required for normal and stable operation of the pump and thus to avoid pressure boost in the separator.

And at last, installation of the jet pump at the pump's inlet gives a possibility to adjust operation mode of the whole pumping-ejector unit in a wide range by adjusting of the jet pump's capacity. Capacity of the jet pump can be adjusted in a simple way, for example by varying of motive liquid volume being fed into the jet pump's nozzle. All that allows to avoid the usage of a complex control system for the adjustment of operation mode of the pump.

Thus, the above described variants of embodiment of the pumping-ejector unit allow to solve the stated technical problems, namely to ensure higher reliability of the unit regardless of whether the pressure in the separator higher or lower then the atmospheric pressure, to increase effectiveness of the unit and to extend the control range of its operating modes.

BRIEF DESCRIPTION OF DRAWINGS

Diagram in FIG. 1 represents the pumping-ejector unit with motive liquid bypassing from the pump's discharge.

Figure 1:
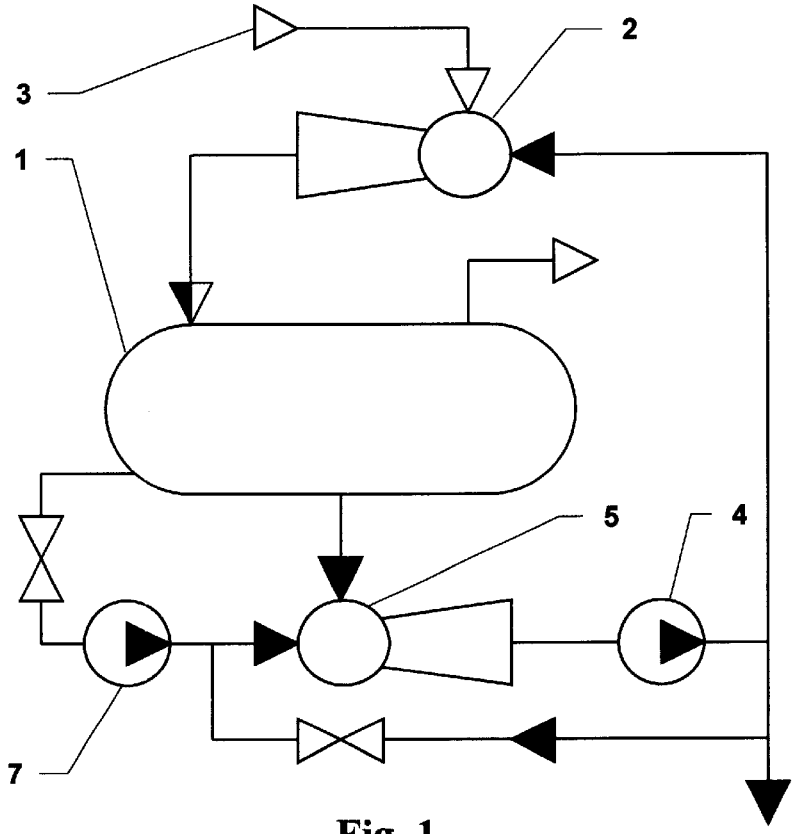

Pumping-ejector unit (FIG. 1) comprises a separator 1, a liquid-gas ejector 2 connected through its gas inlet to a source 3 of evacuated gaseous medium, through its outlet—to the separator 1 and through its nozzle's inlet—to the discharge side of a pump 4. The unit is furnished with a jet pump 5. Outlet of the jet pump is connected to the suction side of the pump 4, inlet of the jet pump's nozzle is connected to the discharge side of the pump 4, evacuated medium inlet of the jet pump 5 is connected to the separator 1.

Figure 2:
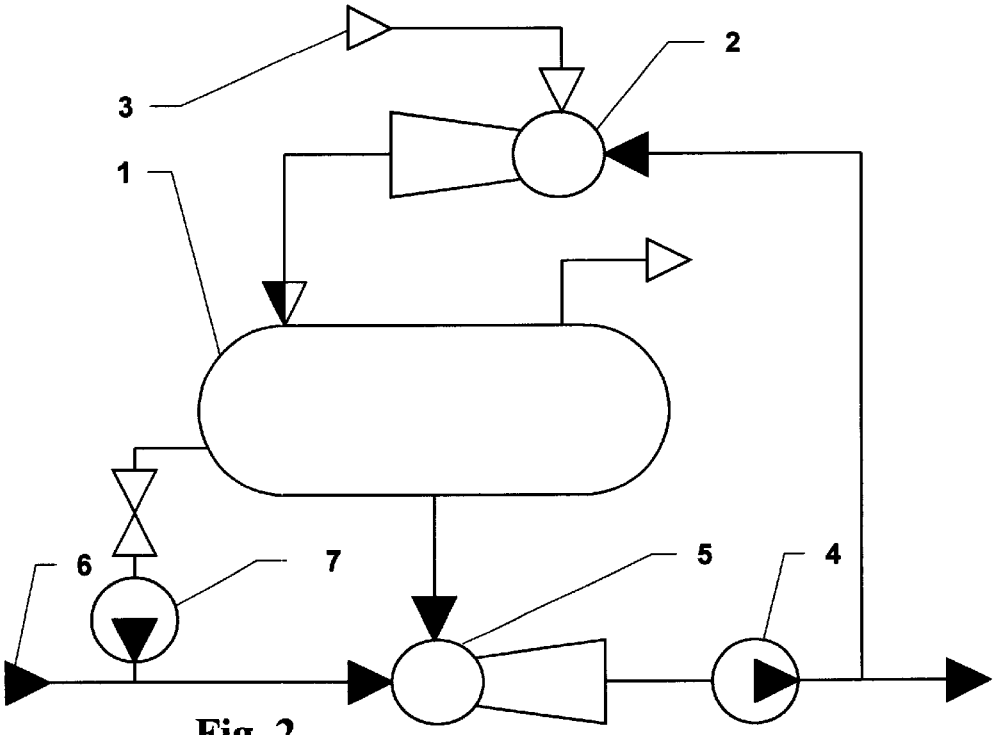
FIG. 2 represents the variant of the unit's embodiment, wherein an ejecting medium is fed into the nozzle of the jet pump from an external source.

Difference between the pumping-ejector unit in FIG. 2 and the unit in FIG. 1 is that the nozzle of the jet pump 5 of the unit in FIG. 2 is connected to a source 6 of ejecting medium, not to the discharge side of the pump 4.

There is the variant of embodiment of the unit wherein either of the described units is equipped with an additional pump 7, whose suction side is connected to the separator 1 and discharge side is connected to the nozzle of the jet pump 5.

The pumping-ejector units operate as follows.

Prior to starting of the unit the separator 1 is filled with a required volume of motive liquid, which can amounts up to a one third of the separator's space. The pump 4 delivers the motive liquid simultaneously into the nozzle of the jet pump 5 and into the nozzle of the liquid-gas ejector 2. The jet pump 5 transfers the motive liquid from the separator 1 to the suction port of the pump 4. The liquid-gas ejector 2 evacuates a gaseous medium from the source 3, compresses the gaseous medium and then delivers mixture of the evacuated gas and the motive liquid into the separator 1. The gas-liquid mixture is separated in the separator 1 into the compressed gas and the motive liquid. Subject to application the compressed gas from the separator 1 is delivered to a consumer or discharged out from the unit. The motive liquid from the separator 1 flows to the evacuated medium inlet of the jet pump 5. The jet pump 5 delivers the motive liquid to the suction port of the pump 4.

In another variant of embodiment of the unit a motive liquid medium is fed into the nozzle of the jet pump 5 from the source 6 of ejecting medium. Further operation of this pumping-ejector unit is similar to the described one. The jet pump 5 delivers mixture of motive liquids from the source 6 and the separator 1 to the suction port of the pump 4. The pump 4 feeds the motive liquid into the nozzle of the liquid-gas ejector 2, which evacuates the gaseous medium and delivers the gas-liquid mixture to the separator 1. The mixture is separated in the separator 1 into the compressed gas and the motive liquid. Because in this variant of the unit's embodiment the motive liquid is fed into the unit from the source 6 continuously, it is necessary to discharge surplus amount of the motive liquid from the unit continuously as well. The surplus of the motive liquid can be tapped from the separator 1 or, for example, from the discharge side of the pump 4. In case the unit is furnished with the additional pump 7, the motive liquid is delivered from the separator 1 to the nozzle of the jet pump 5 by this additional pump. Feed of the motive liquid into the jet pump 5 can be effected by the pump 7 both simultaneously with the motive liquid delivery from the pump 4 or from the source 6 and without delivery of the motive liquid from the pump 4 or from the source 6.

INDUSTRIAL APPLICABILITY

The given pumping-ejector unit can be used in chemical, petrochemical, food and other industries, where gas evacuation and compression are required.

What is claimed is:

1. A pumping-ejection unit, comprising:

a separator;

a liquid-gas ejector having a gas inlet, a liquid inlet and an outlet;

a pump having a suction side and a discharge side; and a jet pump having an ejecting medium inlet, an evacuated medium inlet and an outlet;

wherein the gas inlet of the liquid-gas ejector is directly connected to a source of an evacuated gaseous medium, the outlet of the liquid-gas ejector is directly connected to the separator, the liquid inlet of the liquid-gas ejector is connected to the discharge side of the pump, the outlet of the jet pump having a direct connection to the suction side of the pump, the ejecting medium inlet of the jet pump is connected to the discharge side of the pump, and the evacuated medium inlet of the jet pump is directly connected to the separator.

2. The pumping-ejection unit according to claim 1, further including an additional pump having an additional pump suction side and an additional pump discharge side, wherein the additional pump suction side is connected to the separator, and the additional pump discharge side is connected to the ejecting medium inlet of the jet pump.

3. A pumping-ejection unit, comprising:

a separator;

a liquid-gas ejector having a gas inlet, a liquid inlet and an outlet;

a pump having a suction side and a discharge side;

a jet pump having an ejecting medium inlet, an evacuated medium inlet and an outlet; and a source of an ejecting medium;

wherein the gas inlet of the liquid-gas ejector is connected to a source of an evacuated gaseous medium, the outlet of the liquid-gas ejector is connected to the separator, the liquid inlet of the liquid-gas ejector having a direct connection to the discharge side of the pump, the outlet of the jet pump having a direct connection to the suction side of the pump, the ejecting medium inlet of the jet pump is connected to the source of the ejecting medium, and the evacuated medium inlet of the jet pump is connected to the separator.

4. The pumping-ejection unit according to claim 3, further including an additional pump having an additional pump suction side and an additional pump discharge side, wherein the additional pump suction side is connected to the separator, and the additional pump discharge side is connected to the ejecting medium inlet of the jet pump.

* * * * *